United States Patent [19]

Steffen et al.

[11] Patent Number: 5,072,820

[45] Date of Patent: Dec. 17, 1991

[54] ESCALATOR HANDRAIL STOP DEVICE

[75] Inventors: Matthias Steffen, Kirchbrak; Gerald Wente, Pohle, both of Fed. Rep. of Germany

[73] Assignee: Otis Elevator Company, Farmington, Conn.

[21] Appl. No.: 700,005

[22] Filed: May 14, 1991

[51] Int. Cl.[5] ..... B66B 29/00

[52] U.S. Cl. ..... 198/323; 198/331; 198/336

[58] Field of Search ..... 198/323, 331, 336, 502.4

[56] References Cited

U.S. PATENT DOCUMENTS

| | | | |
|---|---|---|---|
| 2,071,813 | 2/1937 | Bouton et al. | 198/323 X |
| 2,646,868 | 7/1953 | Eames | 198/323 |
| 2,885,057 | 5/1959 | Hansen | 198/323 |
| 3,580,376 | 5/1971 | Loshbough | 198/323 |
| 3,743,913 | 7/1973 | Rebucci | 198/502.4 X |
| 4,564,099 | 1/1986 | Uozumi | 198/323 |

OTHER PUBLICATIONS

Ueki, Yasuo, "An Outdoor Escalator with Remote Supervision and Control"; Mitsubishi Electr. Adv. (Japan), vol. 6, Dec. 1978, pp. 21–23.

*Primary Examiner*—D. Glenn Dayoan
*Attorney, Agent, or Firm*—William W. Jones

[57] ABSTRACT

The handrail of an escalator is continuously monitored for movement by a sensor assembly. In the event that the handrail stops moving, the escalator steps are stopped so as to provide a safe environment for passengers on the escalator. The system can also be used with moving walkways equipped with moving handrails.

6 Claims, 3 Drawing Sheets

ESCALATOR HANDRAIL STOP DEVICE

DESCRIPTION

1. Technical Field

This invention relates to an escalator or moving walkway handrail safety device, and more particularly to a system for shutting down an escalator or walkway if the handrails, or one of them stop moving.

2. Background Art

Escalators and moving walkways are generally always provided with handrails which move in synchrony with the steps or treads of the people mover. The electric motor which drives the step or tread chains will also provide the motive power for driving the handrail. When a fault condition is sensed at the step or tread comb plate; at the handrail reentry port; or with the movement or positioning of the steps, the electric motor will be shut off by a controller microprocessor, or by a simple mechanical switch, or the like. This will concurrently stop step or tread and handrail movement thereby providing a safe environment on the escalator or walkway for passengers. Thus, if the steps or treads stop moving, the handrail will also stop moving. It is also desirable to be able to stop the escalator or walkway steps or treads from moving in the event of cessation of movement of the handrail.

DISCLOSURE OF THE INVENTION

This invention relates to an assembly for monitoring handrail movement to ensure that the handrail is moving at the correct speed, and to shut down the escalator or walkway when unacceptable handrail motion is detected. Unacceptable handrail motion can be moving too fast, too slow, or not moving at all. The assembly is mounted in the return area of the handrail out of sight and where it cannot be tampered with. In a preferred embodiment of the invention, a roller is pressed against the underside of the handrail so that the roller will be rotated by movement of the handrail. The roller, by reason of its rotation, produces a pulsing signal which is monitored by a sensor mounted adjacent to the roller. The sensor is connected to a controller or switching device which will shut down the main drive when the pulsing signal is in an atypical state indicating unacceptable handrail motion.

It is therefore an object of this invention to provide a device for monitoring movement of an escalator or moving walkway handrail.

It is a further object of the invention to provide a device of the character described which can detect changes in the speed of movement of the handrail.

It is another object of the invention to provide a device of the character described which can shut down the main power source for the escalator or walkway in the event that atypical movement of the handrail is detected.

These and other objects and advantages of the invention will become more readily apparent to one skilled in the art from the following detailed description of a preferred embodiment thereof when taken in conjunction with the accompanying drawings, in which:

BEST MODE FOR CARRYING OUT THE INVENTION

Figure 1:
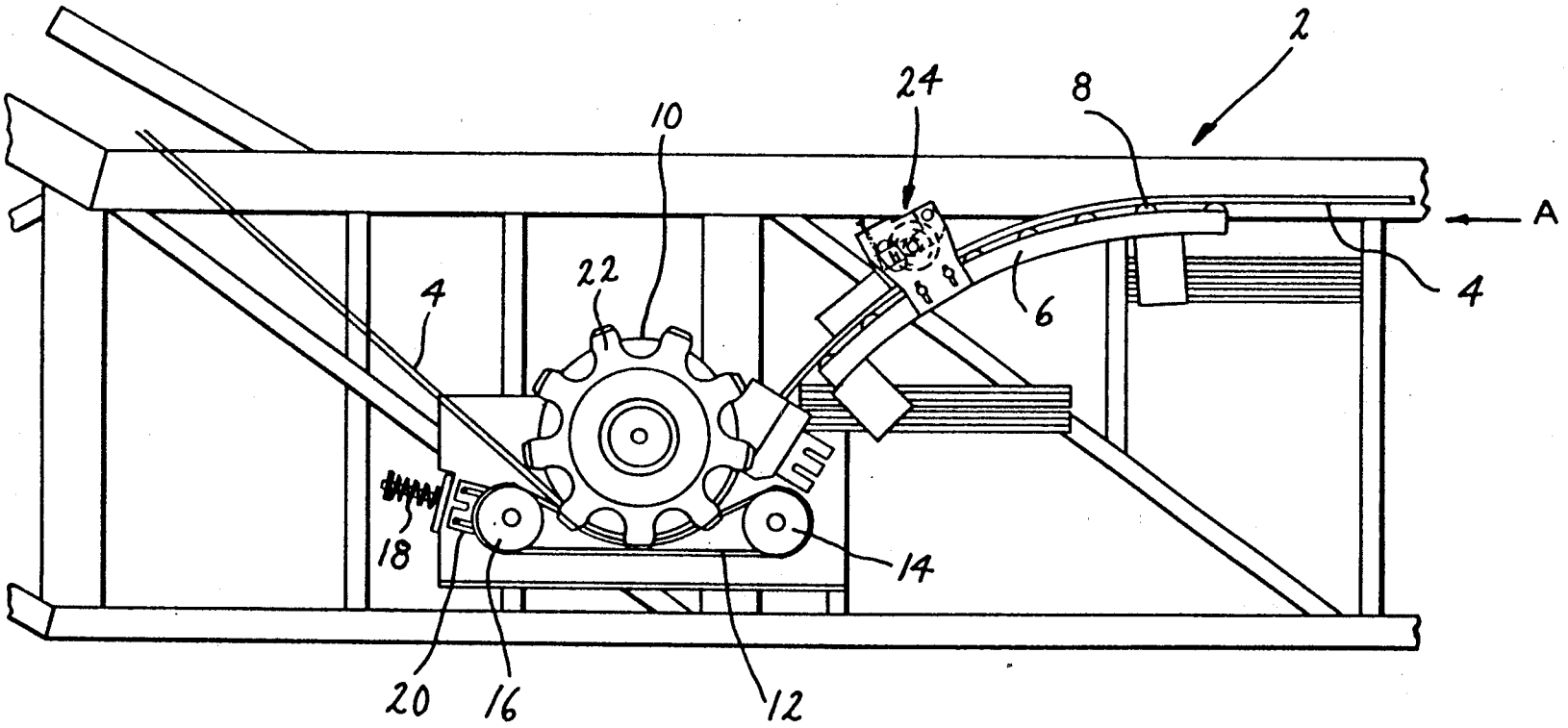
FIG. 1 is a fragmented side elevational view of the return path of the handrail showing the main handrail drive and the positioning of the handrail speed sensor relative thereto.

Referring now to FIG. 1, there is shown the substructure of a lower landing portion of an escalator. The substructure includes a truss 2 on which the various components of the escalator are mounted. The handrail is denoted by the numeral 4 and comes of a curved balustrade newell (not shown) traveling in the direction of the arrow A. The handrail 4 passes over a guide 6 along rollers 8 and into the nip between a drive roller 10 and a drive belt 12 mounted on pulleys 14 and 16. The belt 12 is tensioned by a spring 18 acting on the mount bracket 20 for the pulley 16. The roller 10 is driven by a sprocket 22 which engages the step chains (not shown) of the escalator step. It will be understood that the step chains are driven by the main power source for the escalator. The handrail motion detector is denoted generally by the numeral 24 and is mounted on the guide 6.

Figure 5:
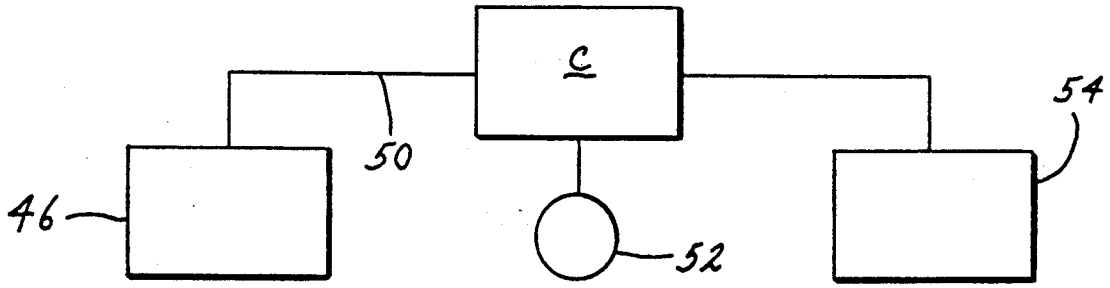
FIG. 5 is a schematic view showing the connection between the sensor assembly and the main drive for the escalator or walkway.
Figure 2:
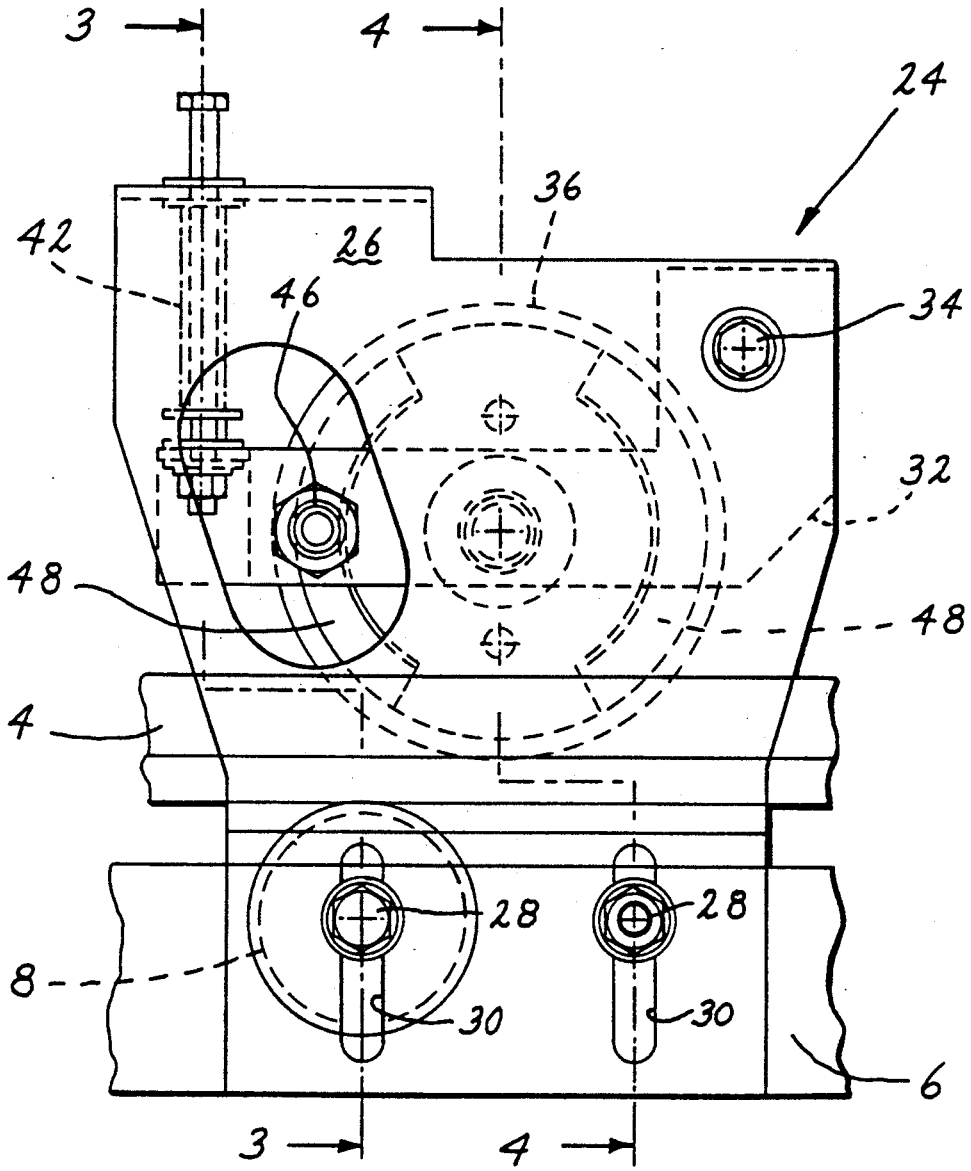
FIG. 2 is a front elevational view of the handrail speed sensor assembly.
Figure 3:
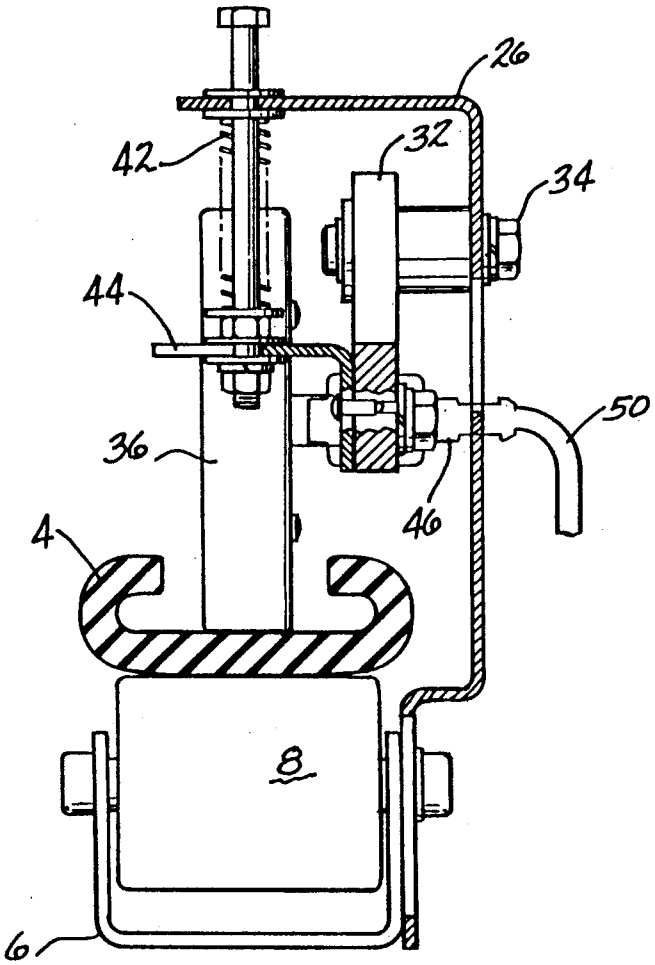
FIG. 3 is a sectional view of the sensor assembly taken along line 3—3 of FIG. 2.
Figure 4:
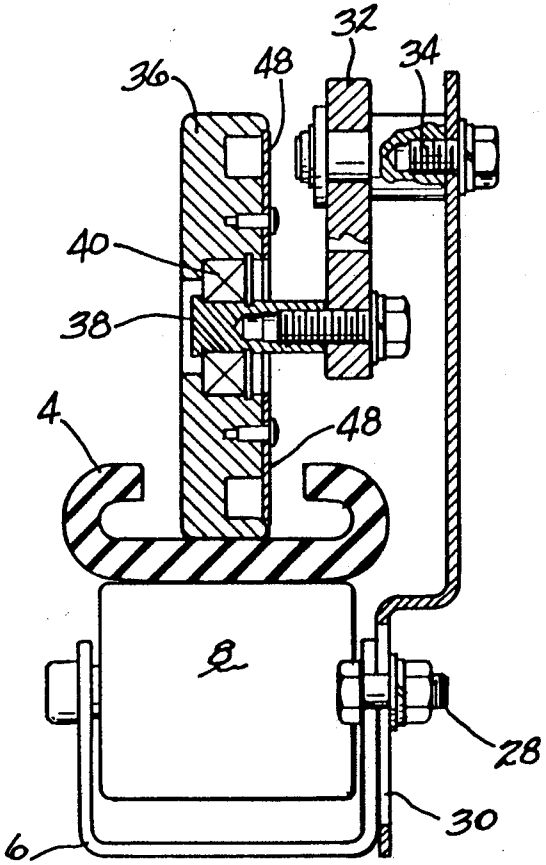
FIG. 4 is a sectional view of the sensor assembly taken along line 4—4 of FIG. 2.

Referring to FIGS. 2–4, details of the motion detector 24 are shown. The detector assembly 24 includes a mount bracket 26 secured to the guide 6 by bolts 28 passing through elongated slots 30 in the bracket 26. A lever 32 is pivoted on the bracket 26 on a pin 34 and a roller 36 is journaled on the lever 32 on an axle 38 and bearing 40. A spring 42 mounted on a spring guide 44 engages the bracket 26 and a stop 44 secured to the lever 32 so as to urge the roller 36 against the underside of the handrail 4. A sensor 46 is mounted on the lever 32 opposite the roller 36. The sensor 46 is an induction proximity sensor which senses two metal plates 48 which are fastened to the side of the roller 36. The sensor 46 is electrically connected to the escalator controller C by a line 50 (see FIG. 5).

So long as the sensor 46 keeps signalling the controller C that the plates 48 are moving at the prescribed speed, the controller C does nothing. When atypical speed of the roller 36 is detected, a signal is sent to the controller C causing it to sound an audible alarm 52. A timer is then activated in the controller C. If the atypical signals continue past a preset time period, the controller C will shut down the main power source 54 for the escalator.

It will be readily appreciated that the handrail motion motor of this assembly will provide dependable, trouble-free operation. It is of simple construction and can be easily retrofitted to existing escalators or moving walkways. The induction proximity sensor is relatively impervious to the contaminants such as grease, dust, dirt and the like found in the escalator truss environment. The mounting of the roller and the sensor on the same lever ensures that proper orientation of the two interacting components will be preserved.

Since many changes and variations of the disclosed embodiment of the invention may be made without departing from the inventive concept, it is not intended to limit the invention otherwise than as required by the appended claims.

What is claimed is:

1. An escalator safety assembly for monitoring escalator handrail movement, said assembly comprising:

(a) means for producing a pulsed signal in response to movement of the handrail, said pulsed signal having a pulse rate which is proportional to the speed of movement of the handrail, said means for producing a pulsed signal comprising a roller contacting the handrail for rotation responsive to movement of the handrail, said roller carrying a metal plate fastened to a side of the roller;

(b) a sensor for monitoring said pulse rate, said sensor being operably connected to a power source for the escalator, and said sensor being operable to initiate an interruption of power from said power source when said pulse rate lies outside of a predetermined range corresponding to a range of acceptable handrail velocities and said sensor comprising an induction proximity sensor disposed adjacent to said roller; and (c) audible alarm means connected to said sensor and actuable by the latter when said pulse rate initially strays from said predetermined range and prior to interruption of power.

2. The escalator safety assembly of claim 1 wherein said roller and said proximity sensor are mounted on a common lever so as to maintain a common geometric relationship one to the other.

3. The escalator safety assembly of claim 2 further comprising spring means engaging said lever to bias said roller against the handrail.

4. An escalator safety assembly for monitoring escalator handrail movement, said assembly comprising:

(a) roller means mounted adjacent to the handrail and in contact with a surface of the handrail whereby the roller means will rotate at speeds which are proportional to the speeds of movement of the handrail;

(b) at least one discrete metal plate mounted on a side of said roller means;

(c) an induction proximity sensor disposed adjacent to said roller means and operable to sense passage of said metal plate as said roller means rotates;

(d) electronic control means operably connected to said proximity sensor and to a power source for the escalator, said control means being operable to receive pulsed signals from said proximity sensor at pulse rates corresponding to the rotational speed of said roller means, and said control means being operable to interrupt power to said escalator power source when said pulse rates fall outside of a predetermined range of pulse rates which confirm normal handrail speeds; and (e) a sensible alarm means connected to said control means and operable to produce a sensible indication of handrail movement speed abnormalities prior to interruption of escalator power.

5. The escalator safety assembly of claim 4 wherein said roller means and said proximity sensor are mounted on a common lever adjacent to the handrail to maintain a common geometric relationship one to the other.

6. The escalator safety assembly of claim 5 further comprising spring means acting on said lever to bias said roller means against said handrail.

* * * * *